US009739488B2

(12) United States Patent
Koizumi et al.

(10) Patent No.: US 9,739,488 B2
(45) Date of Patent: Aug. 22, 2017

(54) GAS TURBINE COMBUSTOR WITH TWO KINDS OF GAS FUEL SUPPLY SYSTEMS

(71) Applicant: Mitsubishi Hitachi Power Systems, Ltd., Nishi-ku, Yokohama (JP)

(72) Inventors: Hiromi Koizumi, Yokohama (JP); Tatsuya Sekiguchi, Yokohama (JP); Akinori Hayashi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 0 days.

(21) Appl. No.: 14/729,813

(22) Filed: Jun. 3, 2015

(65) Prior Publication Data

US 2015/0354823 A1 Dec. 10, 2015

(30) Foreign Application Priority Data

Jun. 4, 2014 (JP) ..... 2014-116071

(51) Int. Cl.
*F23R 3/28* (2006.01)
*F23R 3/36* (2006.01)
*F23R 3/14* (2006.01)

(52) U.S. Cl.
CPC ..... *F23R 3/286* (2013.01); *F23R 3/36* (2013.01); *F23R 3/14* (2013.01); *F23R 2900/00002* (2013.01)

(58) Field of Classification Search
CPC .. F23R 3/286; F23R 3/14; F23R 3/283; F02C 6/08
See application file for complete search history.

(56) References Cited

U.S. PATENT DOCUMENTS 4,364,522 A * 12/1982 Reider ..... B05B 7/10 239/399
7,797,942 B2 * 9/2010 Saitoh ..... F23R 3/343 60/737

(Continued)

FOREIGN PATENT DOCUMENTS

EP 2 551 596 A2 1/2013
EP 2 634 486 A1 9/2013

(Continued)

OTHER PUBLICATIONS

Extended European Search Report issued in counterpart European Application No. 15170432.7 dated Oct. 1, 2015 (Six (6) pages).

*Primary Examiner* — Pascal M Bui Pho
*Assistant Examiner* — Stefan Ibroni
(74) *Attorney, Agent, or Firm* — Crowell & Morign LLP

(57) ABSTRACT

A gas turbine combustor is provided that can stably burn two kinds of gas fuels having different heating values by means of the same burner. In the gas turbine combustor that includes a combustion chamber for mixing fuel and air for combustion and a burner, disposed upstream of the combustion chamber, for jetting fuel and air into the combustion chamber and holding flames, the burner has a first swirler including a plurality of fuel holes and of air holes circumferentially alternately and a second swirler including a plurality of holes through which to jet fuel or air, the second swirler is disposed on the outer circumference of the first swirler, and each of the holes of the second swirler is greater in width than each of the air holes of the first swirler.

2 Claims, 7 Drawing Sheets

(56) References Cited

U.S. PATENT DOCUMENTS

| | | | | |
|---|---|---|---|---|
| 2010/0281872 | A1* | 11/2010 | Hadley | F23D 14/58<br>60/748 |
| 2013/0029277 | A1* | 1/2013 | Koizumi | F23R 3/10<br>431/354 |
| 2013/0219903 | A1* | 8/2013 | Koizumi | F23R 3/286<br>60/772 |
| 2014/0069079 | A1* | 3/2014 | Koizumi | F23R 3/12<br>60/39.463 |

FOREIGN PATENT DOCUMENTS

| | | | |
|---|---|---|---|
| EP | 2 706 295 | A1 | 3/2014 |
| JP | 5-86902 | A | 4/1993 |

* cited by examiner

| | | First swirler | | Second swirler |
|---|---|---|---|---|
| Swirler hole | | Air hole | Gas hole | Gas hole |
| Fuel | Blast furnace gas | Air | Gas | Gas |
| | Coke oven gas | Air | Gas | Bleed air |

GAS TURBINE COMBUSTOR WITH TWO KINDS OF GAS FUEL SUPPLY SYSTEMS

BACKGROUND OF THE INVENTION

1. Field of the Invention

The present invention relates generally to gas turbine combustors and more specifically to a gas turbine combustor that allows the same burner to burn two kinds of fuel gases with different heating values.

2. Description of Related Art

In recent years, the beneficial use of blast furnace gas (BFG) and coke oven gas (COG) co-produced in steel plants has been examined from a viewpoint of a reduction in power generation cost, the beneficial use of resources and the prevention of global warming. Blast furnace gas is produced in steel production process and is flame retardation gas containing carbon monoxide and hydrogen as main flammable gas. In addition, the blast furnace gas is a so-called low Btu gas having a heating value of about 1000 kcal/$m^3$N. Therefore, it is difficult to stably operate the gas turbine through blast furnace gas mono-firing over a period ranging from ignition to a full load operation. To stably operate the gas turbine for combustion over a range from the ignition to a partial load with low combustion temperature, it is necessary to mix coke oven gas containing hydrogen with blast furnace gas to increase a heating value for operation (carburetion), or to separately provide start-up fuel such as liquid fuel.

On the other hand, the coke oven gas is off gas that is produced when coke, which is the raw material for the blast furnace, is produced. In addition, the coke oven gas is medium Btu gas, which contains hydrogen and methane as major composition and has a heating value of 4000 kcal/$m^3$N to 5000 kcal/$m^3$N. Containing hydrogen, the coke oven gas has a heating value higher than that of the blast furnace gas. Therefore, the coke oven gas is used as a carburetion gas for blast furnace gas firing gas turbines, or as a main fuel for coke oven gas firing gas turbines.

To stably burn low Btu gas such as BFG, a gas turbine combustor is provided that includes a start-up oil nozzle located at the radially central portion of a burner, an inner swirler having gas holes arranged on the outer circumference thereof, and an outer swirler in which gas holes and air holes are alternately arranged on the outer circumference of the inner swirler (see JP-5-86902-A).

In general, burners stabilize flames using swirl flows. In order to stabilize flames, such a burner need to have a recirculation zone formed in the vicinity of the radially central portion of the burner. The recirculation zone is applied to circulate combustion gas and convey heat to the fuel and air jetted from the burner.

According to the gas turbine combustor described in JP-5-86902-A, only gas holes are arranged in the inner swirler and most of fuel is supplied to the gas holes. By doing so, the kinetic momentum based on a large amount of low Btu gas is utilized to form strong swirl flows, from which the flame stabilization is strengthened. Fuel jetted from the inner swirler is taken in the recirculation zone while mixed with air jetted from the outer swirler, so that oxygen (concentration) in the recirculation zone will suffice. Thus, the stable combustion of low Btu gas is possible.

SUMMARY OF THE INVENTION

Gas turbine power-generating facilities that use blast furnace gas as main fuel have heretofore been forced to stop power generation for a long period of time during which a blast furnace installation is maintained. In recent years, however, a need has grown to generate electricity using e.g. coke oven gas as alternative fuel during the maintenance of the blast furnace installation. To achieve such a need, the gas turbine power-generating facilities need to have a combustor that allows one burner to stably burn two kinds of gases with different heating values.

Burning the two kinds of gases with different heating values by use of one burner poses the following problem.

For example, in the gas turbine power-generating facilities that use low Btu gas as main fuel, the main fuel may be switched from blast furnace gas to coke oven gas to maintain a blast furnace installation. In such a case, since the coke oven gas has a heating value about four times higher than low Btu gas such as blast furnace gas, the flow rate of fuel supplied to a combustor decreases according as the heating value increases, becoming about one-fourth that of the low Btu gas. Therefore, if the coke oven gas is to be burned through the gas holes of a low Btu gas firing burner, disadvantageously the swirl flow of the combustion gas will weaken and flame-stabilizing performance will remarkably degrade since the fuel velocity of the coke oven gas is significantly slow.

On the other hand, if it is assumed that blast furnace gas is supplied to a burner designed to meet specifications for coke oven gas, the flow rate of fuel supplied to a combustor will increase about four times that of the coke oven gas. Since a pressure ratio (fuel supply pressure/combustor pressure) in the fuel nozzle increases accordingly, the fuel supply pressure needs to be set higher than usual. However, this disadvantageously not only causes cost-up but also makes it impossible to achieve the flame stabilization of the flame retardation gas since the fuel velocity becomes extremely fast.

A burner designed to meet specifications for low Btu gas has a gas hole whose area is large; therefore the gas hole has to be opened to face a combustion chamber. The problem is that, in this case, operating the gas turbine combustor using start-up fuel makes combustion gas possibly flow backward to another combustor via the gas holes in case an imbalance in pressure between the combustors occurs.

The present invention has been made in view of the above and aims to provide a gas turbine combustor that can stably burn two kinds of gas fuels with different heating values by means of the same burner.

According to one aspect of the present invention, there is provided a gas turbine combustor, comprising: a combustion chamber that mixes and burns fuel and air; and a burner disposed upstream of the combustion chamber, the burner jetting fuel and air into the combustion chamber and holding flames in the chamber. The burner includes a first swirler having a plurality of fuel holes and a plurality of air holes formed circumferentially of the first swirler in an alternate manner and a second swirler formed with a plurality of holes through which to jet fuel or air. The second swirler is arranged over the outer circumference of the first swirler. Each of the holes of the second swirler is greater in width than each of the air holes of the first swirler.

According to the present invention, low combustibility gas which contains a high concentration of nitrogen and carbon dioxide, such as blast furnace gas, and gas such as coke oven gas that have a higher heating value than the blast furnace gas can be burned by the same burner. As a result, it is possible for gas turbine combustor to have a stable combustion using, for example, the coke oven gas as main fuel during the maintenance of a blast furnace facilities.

DESCRIPTION OF THE PREFERRED EMBODIMENTS

Preferred embodiments of the present invention will hereinafter be described with reference to the drawings.

First Embodiment

Figure 1:
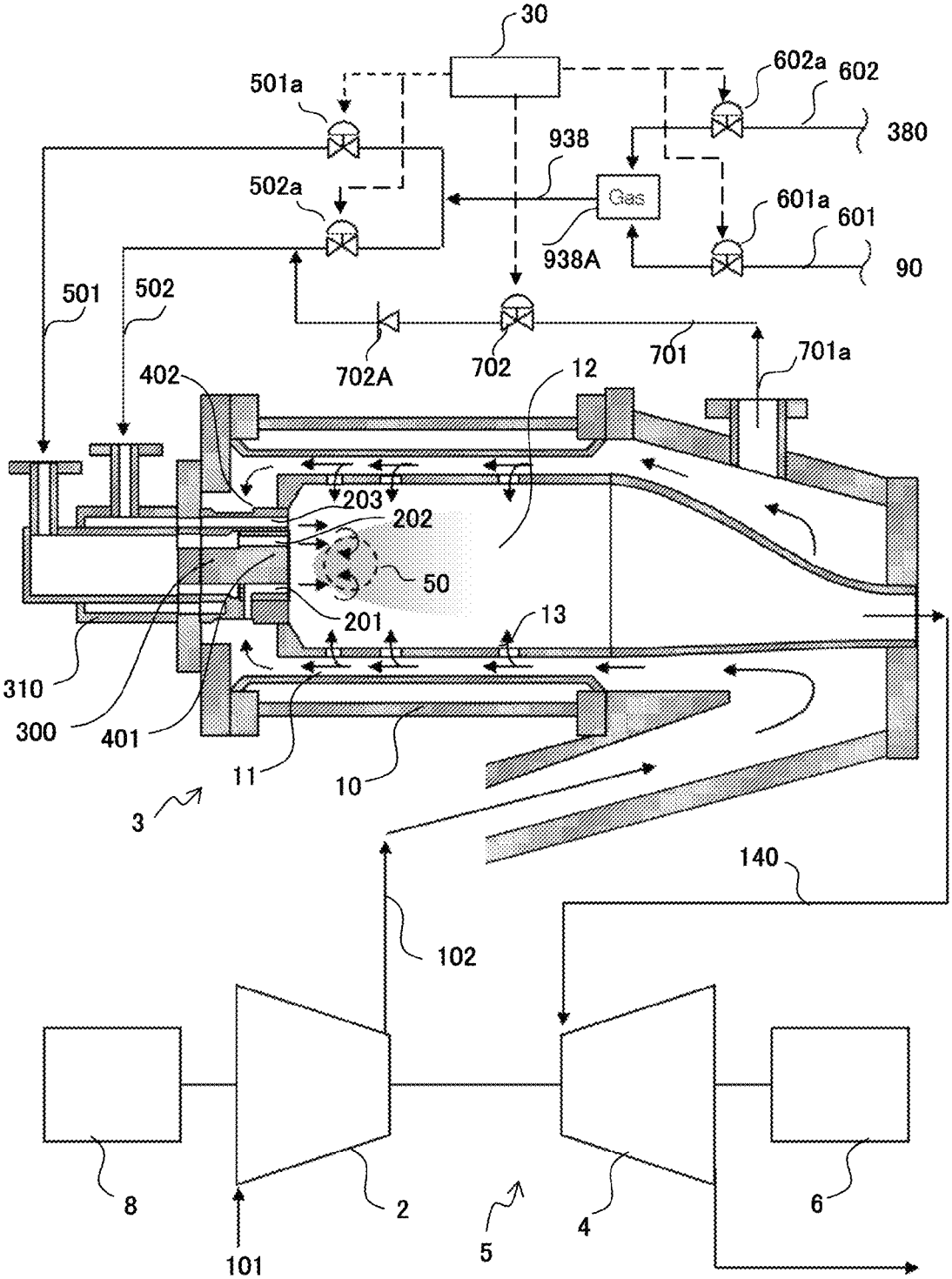
FIG. 1 is a schematic configuration diagram showing a side cross-sectional view of an essential portion of a first embodiment of a gas turbine combustor according to the present invention and a diagrammatic representation of the entire gas turbine plant.

FIG. 1 is a schematic configuration diagram showing a side cross-sectional view of an essential portion of a gas turbine combustor according to a first embodiment of the present invention and a diagrammatic representation of the entire gas turbine plant. The present embodiment uses blast furnace gas 90 as low Btu gas and coke oven gas 380 as middle Btu gas fuel for a gas turbine.

A gas turbine 5 includes an air compressor 2, a combustor 3, a turbine 4, a generator 6 and a start-up motor 8. In the gas turbine 5, the compressor 2 compresses air 101 sucked from the atmosphere and supplies combustion air 102 to the combustor 3. In the combustor 3, the combustion air 102 supplied by the compressor 2 and start-up fuel (here, carburetion gas 938 resulting from mixing the blast furnace gas 90 with the coke oven gas 380) are ignited to produce combustion gas 140, which is supplied to the turbine 4. The turbine 4 is supplied with combustion gas 140 to produce torque. The torque from the turbine 4 is transmitted to the compressor 2 and the generator 6. The torque transmitted to the compressor 2 is used for air compression and the rotative power transmitted to the generator 6 is converted to electric energy.

The combustor 3 includes an outer casing 10 as a pressure vessel, a combustion chamber 12 installed inside the outer casing 10, and a flow sleeve 11 installed on the outer circumference of the combustion chamber 12 so as to cool the combustion chamber 12. A burner 300, which is used to jet fuel and air to stabilize flames, is disposed on the upstream side of the combustion chamber 9.

The combustion air 102 supplied to the combustor 3 flows in the space between the flow sleeve 11 and the combustion chamber 12 and while cooling the combustion chamber 12, the combustion air 102 is supplied into the combustion chamber 12 via air holes 13 provided in the side wall of the combustion chamber 12 and via air holes 201 provided in the burner 300.

The burner 300 is a double swirl burner having a first swirler 401 and a second swirler 402. The first swirler 401 has gas holes 202 adapted to jet the blast furnace gas 90 or the coke oven gas 380 into the combustion chamber 12 and air holes 201 adapted to jet the combustion air 102. The second swirler 402 has holes 203.

The first swirler 401 and the second swirler 402 are secured to a burner body 310. A first fuel system 501 for supplying fuel to the first swirler 401 and a second fuel system 502 for supplying fuel or bleed air 701*a* to the second swirler 402 are connected to the burner body 310. A first fuel system flow control valve 501*a* is installed in the first fuel system 501. A second fuel system flow control valve 502*a* is installed in the second fuel system 502. The first fuel system flow control valve 501*a* and the second fuel system flow control valve 502*a* are controlled in respective openings by a controller 30.

A mixer 938A is disposed upstream of the first fuel system 501 and the second fuel system 502. Fuel gas is supplied from the output side of the mixer 938A to the upstream side of the fuel system flow control valves 501*a*, 502*a*. A blast furnace gas system 601 for supplying the blast furnace gas 90 and a coke oven gas system 602 for supplying the coke oven gas 380 are connected to the input side of the mixer 938A. A blast furnace gas system flow control valve 601*a* is provided in the blast furnace gas system 601. A coke oven gas system flow control valve 602*a* is provided in the coke oven gas system 602. The blast furnace gas system flow control valve 601*a* and the coke oven gas system flow control valve 602*a* are controlled in respective openings by the controller 30.

BFG 90 or the coke oven gas 380 and carburetion gas (the carburetion gas 938 is produced by mixing the coke oven gas 380 with the blast furnace gas 90) can be supplied to the gas turbine 5 via the mixer 938A by controlling the respective openings of the system flow control valves 601*a*, 602*a*. The carburetion gas 938 is needed for stable combustion from the start-up and increasing velocity to partial load condition of the gas turbine 5. Incidentally, the carburetion gas 938 is produced by mixing the coke oven gas 380 with the blast furnace gas 90.

A bleed system 701 that supplies the bleed air 701*a* of the gas turbine 5 is connected to the second fuel system 502 communicating with the second swirler 402 at a position on the downstream side of the second fuel system flow control valve 502*a*. The bleed system 701 is connected on the upstream side thereof to a casing of the gas turbine 5. A bleed control valve 702 and a check valve 702A are provided in the bleed system 701 in this order from the upstream side. The bleed control valve 702 controls the flow rate of the bleed air 701. The check valve 702A prevents the backflow of the fuel gas from the combustion chamber 12. The opening of the bleed control valve 702 is controlled by the controller 30.

The controller 30 includes a fuel heating value control section, a first swirler flow control section and a second swirler flow control section, which will be detailed later. The fuel heating value control section controls the opening of the blast furnace gas system flow control valve 601*a* and the opening of the coke oven gas system flow control valve 602*a* in order to produce fuel gas having a predetermined heating value.

The first swirler flow control section controls the opening of the flow control valve 501*a* of the first fuel system 501 in order to ensure the predetermined flow rate of the gas fuel. The second swirler flow control section controls the opening of the flow control valve 502*a* of the second flow system 502 in order to ensure the predetermined flow rate of gas fuel and controls the opening of the bleed air control valve 702 in order to ensure the flow rate of bleed air.

Figure 2:
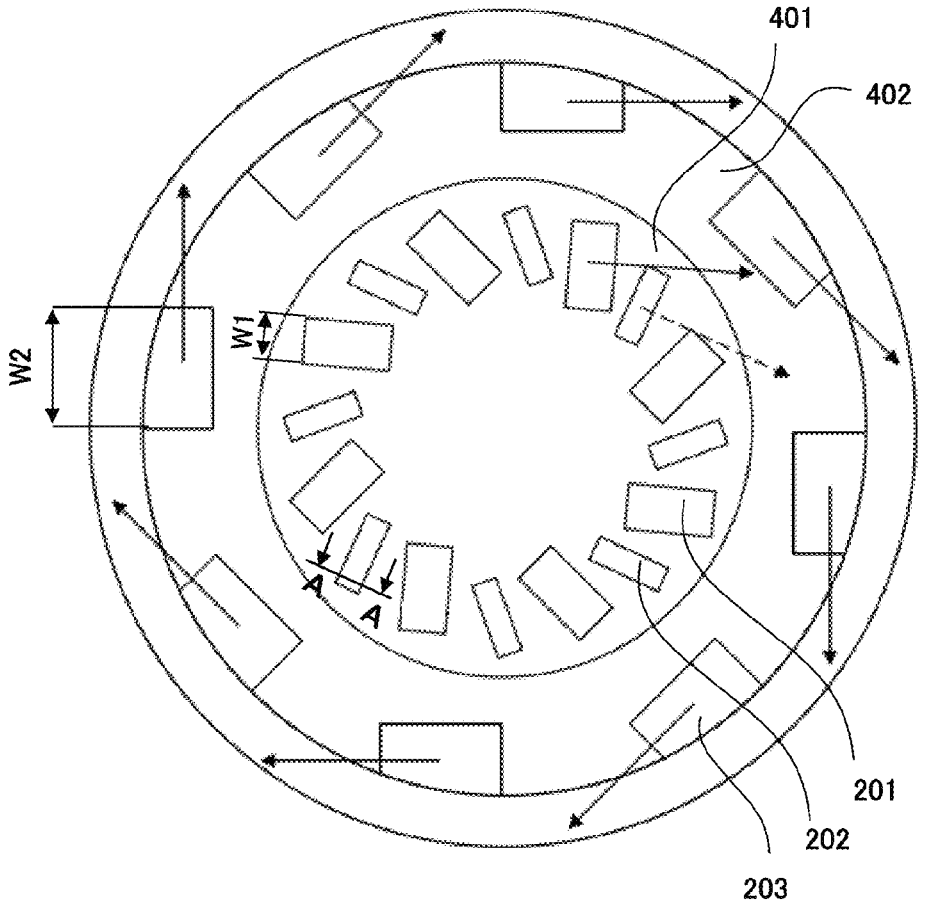
FIG. 2 is a front view of a burner constituting the first embodiment of the gas turbine combustor according to the present invention as viewed from the combustion chamber side.
Figure 3:
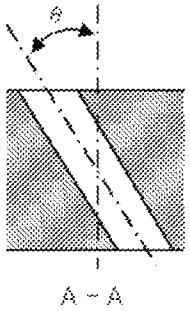
FIG. 3 is a cross-sectional view of the burner as viewed from arrows A-A shown in FIG. 2.
Figures 4, 5:
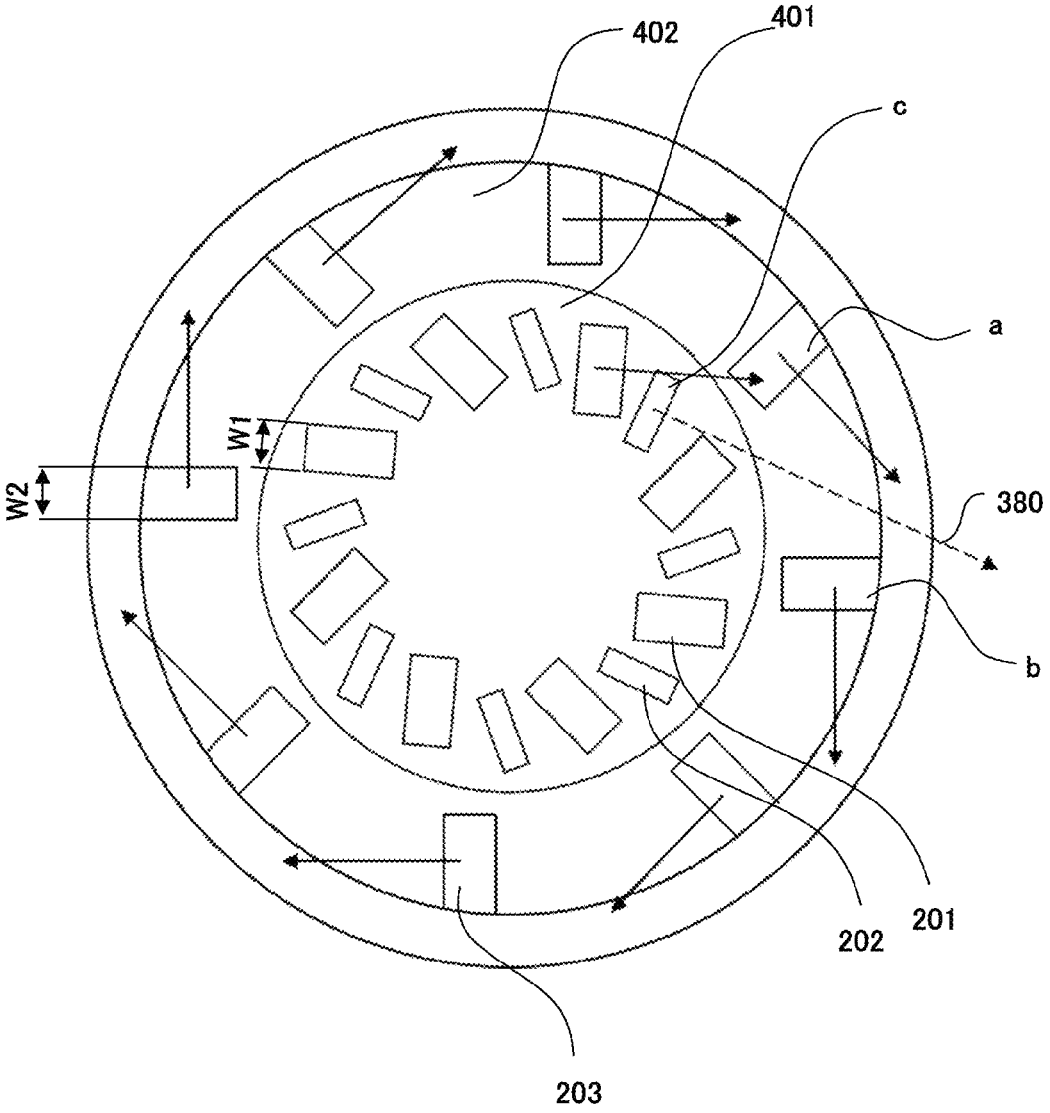
FIG. 4 is a table showing jet fluids of holes with respect to the kinds of fuels in the burner constituting the first embodiment of the gas turbine combustor according to the present invention.
FIG. 5 is a front view of a conventional burner constituting a gas turbine combustor as viewed from the combustion chamber side.

A burner structure is next described with reference to FIGS. 2 to 5. FIG. 2 is a front view of the burner constituting the first embodiment of the gas turbine combustor of the present invention as viewed from the combustion chamber side. FIG. 3 is a cross-sectional view of the burner as viewed from arrows A-A in FIG. 2. FIG. 4 is a table showing jet fluids of the holes with respect to the kinds of fuels in the burner constituting the first embodiment of the gas turbine combustor according to the present invention. In FIGS. 2 to 4, the portions denoted by the same reference numerals as those in FIG. 1 are like portions; therefore, their detailed explanations are omitted.

As illustrated in FIG. 2, the burner 300 of the present embodiment employs a double swirl structure in which the first swirler 401 is disposed at an axially central portion and the second swirler 402 is disposed on the outer circumferential side of the first swirler 401. The first swirler 401 is such that a plurality of the air holes 201 and of the gas holes 202 are alternately arranged in the circumferential direction. The gas hole 202 has a swirl angle $\alpha$ provided as illustrated in FIG. 3. Also the air hole 201 has a swirl angle not shown. In this way, the gas jetted from the gas hole 202 and the air jetted from the air hole 201 are each given a swirl component. Therefore, a negative pressure occurs at the radially central portion of the burner 300. Thus, a recirculation zone for combustion gas can be formed.

The recirculation zone has a role in allowing the circulation of the combustion gas to continuously apply thermal energy to the gas and air supplied from the burner. This can stabilize flames even under a high-velocity condition such as a gas turbine combustor. This flame stabilizing method is effective particularly in the combustion of low combustibility gas with a low heating value.

Several gas holes 203 are circumferentially arranged in the second swirler 402. The present embodiment is characterized by changing the fluid jetted from the gas holes 203 in accordance with the kind (a heating value) of the gas fuel supplied to the gas turbine 5. Specifically, as shown in FIG. 4, the blast furnace gas 90 is supplied from the gas holes 203 of the second swirler 402 in blast gas firing operation. The bleed air 701*a* of the gas turbine 5 is supplied in coke oven gas firing operation.

Details will be described later. The present embodiment is characterized in that the width W2 of the gas hole 203 of the second swirler 402 and the width W1 of the air hole 201 of the first swirler 401 are set so as to have the relationship of W2>W1.

The blast furnace gas 90 is fuel with low reactivity in which the content of inert gas therein accounts for about 70% of the total. In the present embodiment, inner frame and outer frame are formed in the first swirler 401 and the second swirler 402, respectively; therefore, they transfer heat therebetween (interaction), which enhances flame stabilizing property.

On the other hand, the coke oven gas 380 is fuel in which flammable gas therein accounts for about 90% of the total and also 50% or more of hydrogen is contained. Therefore, such fuel is reactive and has high flame temperatures. Coke oven gas firing is such that the coke oven gas 380 has a heating value higher than that of the blast furnace gas 90. Therefore, the flow rate of fuel supplied to the gas turbine combustor 3 is reduced. For this reason, the coke oven gas 380 is supplied only to the first swirler 401 in the present embodiment. If imbalance in pressure between the combustors occurs, combustion gas tends to flow backwards to another combustor via the gas holes 203 of the second swirler 402. To prevent the backflow of the combustion gas, the bleed air 701*a* from the gas turbine casing is supplied to the gas holes 203 of the second swirler 402.

That is to say, if the coke oven gas 380 having a high heating value is supplied of the two kinds of fuels to be supplied to the gas turbine 5, the bleed air 701*a* is supplied to the gas holes 203 of the second swirler 402. In this way, the bleed air 701*a* is supplied into the combustion chamber 12 from the gas holes 203 of the second swirler 402. It is possible, therefore, to prevent the backflow of the combustion gas 140 to another combustor via the gas holes 203. Consequently, reliability is improved.

The coke oven gas 380 is burned to increase flame temperature. Therefore, the wall temperature of the combustion chamber 12 tends to rise due to the flames formed by the first swirler 401. In the present embodiment, since the bleed air 701*a* is supplied, the flames formed in the first swirler 401 can be enclosed by air. Thus, the wall temperature of the combustion chamber 12 can be prevented from being increased.

A conventional burner is next described with reference to FIG. 5 for comparison with the present embodiment. FIG. 5 is a front view of a conventional burner constituting a gas turbine combustor as viewed from the combustion chamber side. In FIG. 5, the portions denoted by the same reference numerals as those shown in FIGS. 1 to 4 are like portions. Therefore, their detailed explanations are omitted.

The conventional burner illustrated in FIG. 5 is different from the burner 300 of the present embodiment in that the width W2 of the gas hole 203 of the second swirler 402 and the width W1 of the air hole 201 of the first swirler 401 are set to have almost the same size; Other configurations are substantially the same. Incidentally, the gas holes 203 in the conventional example and the present embodiment are set to have the same area.

The width of the gas hole 203 of the second swirler 402 is small in the conventional burner. Therefore, a gap between the gas hole 203 of the second swirler 402 denoted by symbol "a" and the gas hole 203 of the second swirler 402 adjacent thereto denoted by symbol "b" is larger than the gap of the present embodiment. Therefore, there is a problem in that the flames of the coke oven gas 380 jetted from the gas holes 202 of the first swirler 401 denoted by symbol "c" pass through the air flow jetted from the gas holes "a" and "b" as the gas holes 203 of the second swirler 402 and easily reach the vicinity of the wall surface of the combustion chamber.

The present embodiment is characterized in that the width W2 of the gas hole 203 of the second swirler 402 is set to be greater than the width W1 of the air hole 201 of the first swirler 401 as described above. In this way, the bleed air 701*a* jetted from the second swirler 402 can enclose the flames formed in the first swirler 401. Consequently, the temperature of the wall surface of the combustion chamber can be prevented from being increased. In addition, flame temperature lowers; therefore, low NOx combustion becomes possible even in a diffusive combustion system.

Figure 6A:
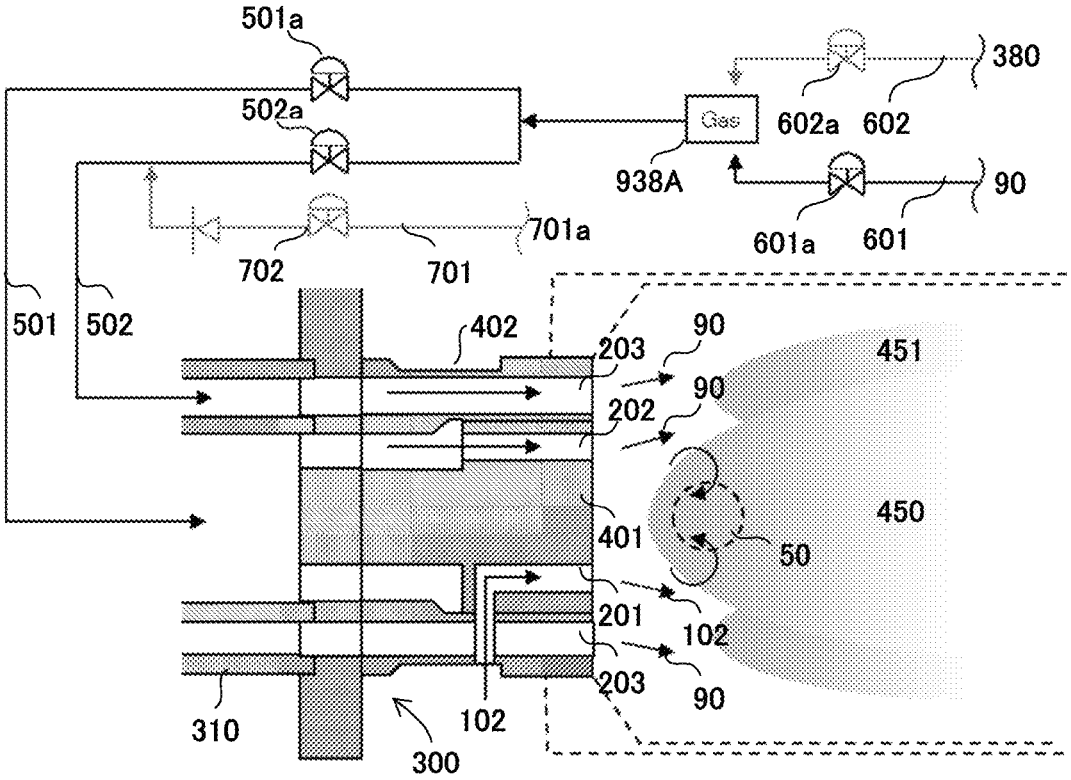
FIG. 6A is a schematic configuration diagram including a lateral cross-sectional view of an essential part of the burner constituting the first embodiment of the gas turbine combustor according to the present invention and also showing a fuel system.
Figure 6B:
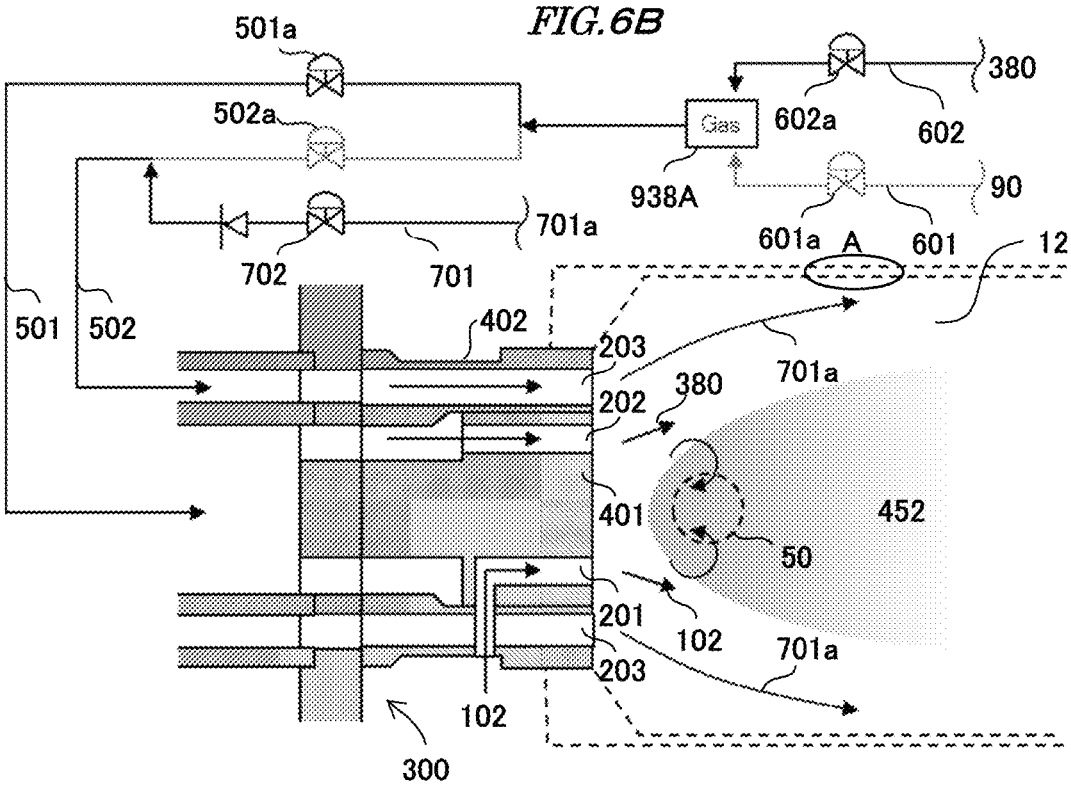
FIG. 6B is another schematic configuration diagram including a lateral cross-sectional view of an essential part of the burner constituting the first embodiment of the gas turbine combustor according to the present invention and also showing the fuel system.

A description is next given of the operation of the fuel system and the burner in the cases of blast furnace gas firing and coke oven gas firing with reference to FIGS. 6A and 6B, respectively. FIG. 6A is a schematic configuration diagram including a lateral cross-sectional view of an essential part of the burner constituting the first embodiment of the gas turbine combustor of the present invention and also showing the fuel system. FIG. 6B is another schematic configuration diagram including a lateral cross-sectional view of an essential part of the burner constituting the first embodiment of the gas turbine combustor of the present invention and also showing the fuel system. In FIGS. 6A and 6B, the portions denoted by the same reference numerals as those in FIGS. 1 to 5 are like portions. Therefore, their detailed explanations are omitted.

FIG. 6A illustrates the fuel system and the cross-section of the burner encountered during the blast furnace gas firing operation. In FIG. 6A, blast furnace gas 90 supplied from the blast furnace gas system 601 is supplied to the first fuel system 501 and the second fuel system 502 via the mixer 938A. The blast furnace gas 90 is supplied from the first fuel system 501 to the first swirler 401. The blast furnace gas 90 is supplied from the second fuel system 502 to the second swirler 402.

The first swirler 401 applies swirls to the blast furnace gas 90 and the combustion air 102. Therefore, a negative pressure occurs at the radially central portion of the burner 300 to form a recirculation zone 50, which stabilizes inner flames 450. The second swirler 402 jets the blast furnace gas 90 into the combustion chamber 12 to form outer flames 451. The interaction between the inner flames 450 and the outer frames 451 (the transfer of heat therebetween) enables the stable combustion of the blast furnace gas 90.

FIG. 6B illustrates the fuel system and the cross-section of the burner encountered during the coke oven gas firing operation. In FIG. 6B, coke oven gas 380 supplied from the coke oven gas system 602 is supplied to the first fuel system 501 via the mixer 938A. The bleed air 701*a* of the gas turbine 5 supplied from the bleed system 701 is supplied to the second fuel system 502. The coke oven gas 380 is supplied from the first fuel system 501 to the first swirler 401. The bleed air 701*a* is supplied from the second fuel system 502 to the second swirler 402.

The first swirler 401 applies swirls to the coke oven gas 380 and the combustion gas 102 to form the recirculation zone 50, which holds the flames 452. In the coke oven gas firing, fuel is supplied only to the first swirler 401; therefore, the bleed air 701*a* is supplied to the gas holes 203 of the second swirler 402. The bleed air 701*a* jetted into the combustion chamber 12 encloses the flames 452 due to the swirl flow. Therefore, the temperature of the flames 452 lowers, which enables low NOx combustion even in the diffusive combustion system. Liner wall metal temperature in the vicinity of a portion denoted by an A-part of the combustion chamber 12 has heretofore tended to rise. However, the bleed air 701*a* covers the outer circumference of the flames 452 in the present embodiment. Thus, an effect of making it possible to lower the liner wall metal temperature of the combustion chamber 12 can be produced.

Figure 7A:
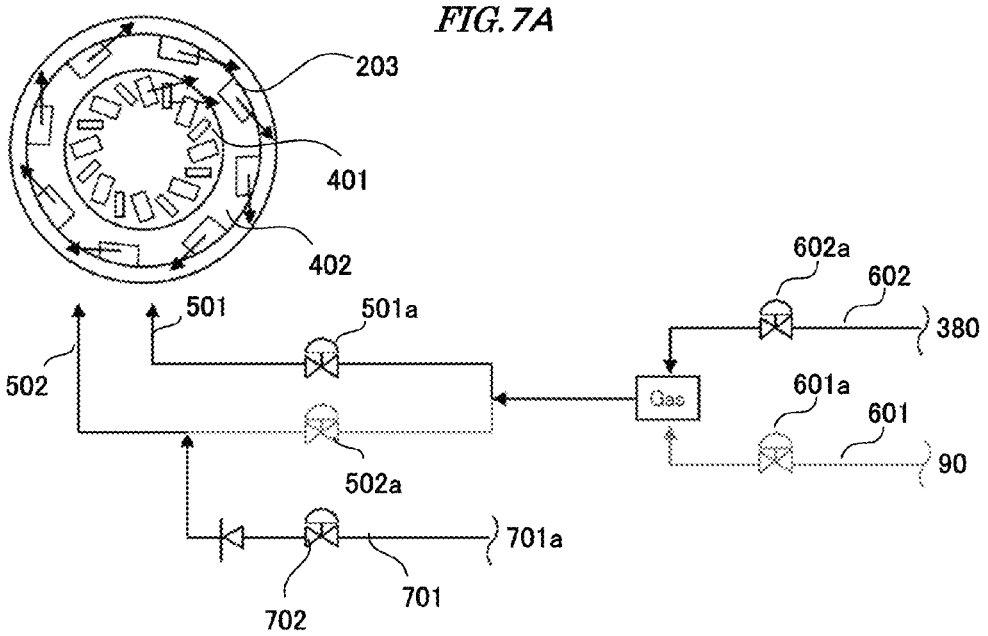
FIG. 7A is a schematic configuration diagram including a front view of the burner constituting the first embodiment of the gas turbine combustor according to the present invention and also showing the fuel system encountered during coke oven gas firing.
Figure 7B:
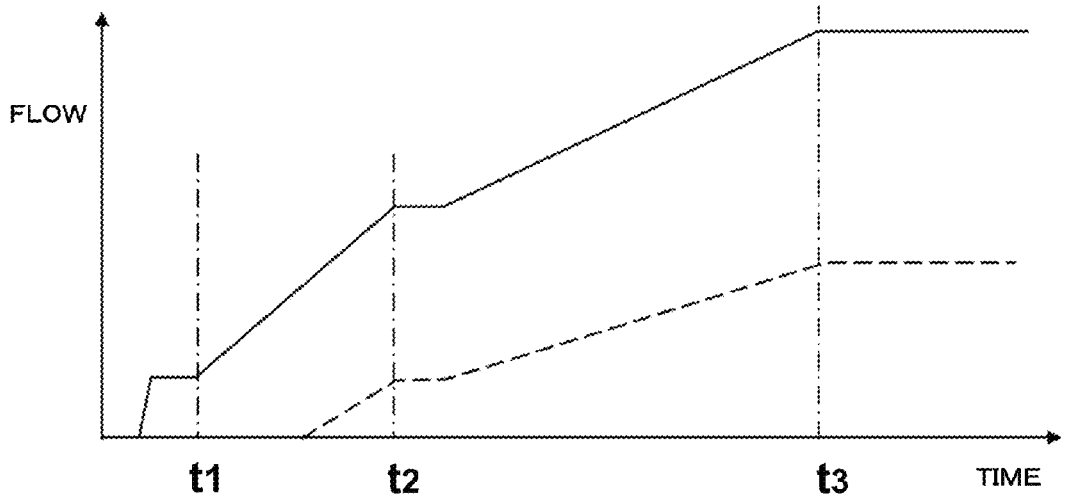
FIG. 7B is a characteristic diagram showing the flow rate of coke oven gas and the flow rate of bleed air encountered during the coke oven gas firing in the first embodiment of the gas turbine combustor of the present invention.

The behavior of the fuel flow and bleed air flow encountered during the coke oven gas firing operation is next described with reference to FIGS. 7A and 7B. FIG. 7A is a schematic configuration diagram including a front view of the burner constituting the first embodiment of the gas turbine combustor of the present invention and also showing the fuel system encountered during the coke oven gas firing. FIG. 7B is a characteristic diagram showing characteristics of the flow rate of the coke oven gas and the flow rate of the bleed air encountered during the coke oven gas firing in the first embodiment of the gas turbine combustor of the present invention. In FIGS. 7A and 7B, portions denoted by the same reference numerals as those in FIGS. 1 to 6B are like portions. Therefore, their detailed explanations are omitted.

As shown in FIG. 7A, the flow control valve 601*a* of the blast furnace gas supply system 601 is closed in order to supply the coke oven gas 380 only to the first swirler 401. In addition, the flow control valve 502*a* of the second fuel system communicating with the second swirler 402 is closed in order to supply the bleed air 701*a* of the gas turbine 5 to the second swirler 402. The flow rate of the bleed air bled from the casing of the gas turbine 5 and supplied to the burner 300 can be adjusted by adjusting the opening of the bleed air control valve 702.

In FIG. 7B, a horizontal axis represents time and a vertical axis represents the flow rate of the coke oven gas and the bleed air. A characteristic denoted by a solid line represents the flow rate of the coke furnace gas 380 and a characteristic denoted by a broken line represents the flow rate of the bleed air 701*a*. In FIG. 7B, symbol $t_1$ denotes the ignition time of the gas turbine 5, symbol $t_2$ denotes the full-speed no-load reaching time of the gas turbine 5 and symbol $t_3$ denotes full load reaching time.

Before the ignition time $t_1$, the coke oven gas 380 is supplied to the first swirler 401. When the ignition is detected in the combustor 3 ($t_1$), the flow rate of the coke oven gas 380 is gradually increased to increase the speed of the gas turbine 5 and the full speed no load reaching time $t_2$ is reached. In the speed-increasing process of the gas turbine 5, the bleed air 701*a* is started to be supplied to the second swirler 402. Consequently, even if the imbalance of pressure between the combustors 3 occurs in the speed-increasing process, it is possible to prevent the backflow of the combustion gas 140 through the gas holes 203 of the second swirler 402.

Thereafter, the flow rate of the coke oven gas 380 is gradually increased to increase the load of the gas turbine 5 and the full load reaching time $t_3$ is reached. The bleed air 701*a* is increased along with the increased load in accordance with the increased flow rate of fuel.

Figure 8A:
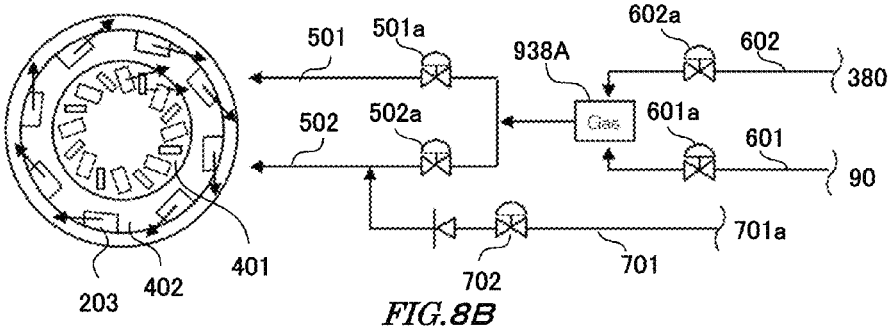
FIG. 8A is a schematic configuration diagram including a front view of the burner constituting the first embodiment of the gas turbine combustor of the present invention and also showing the fuel system encountered during blast furnace gas firing.
Figure 8B:
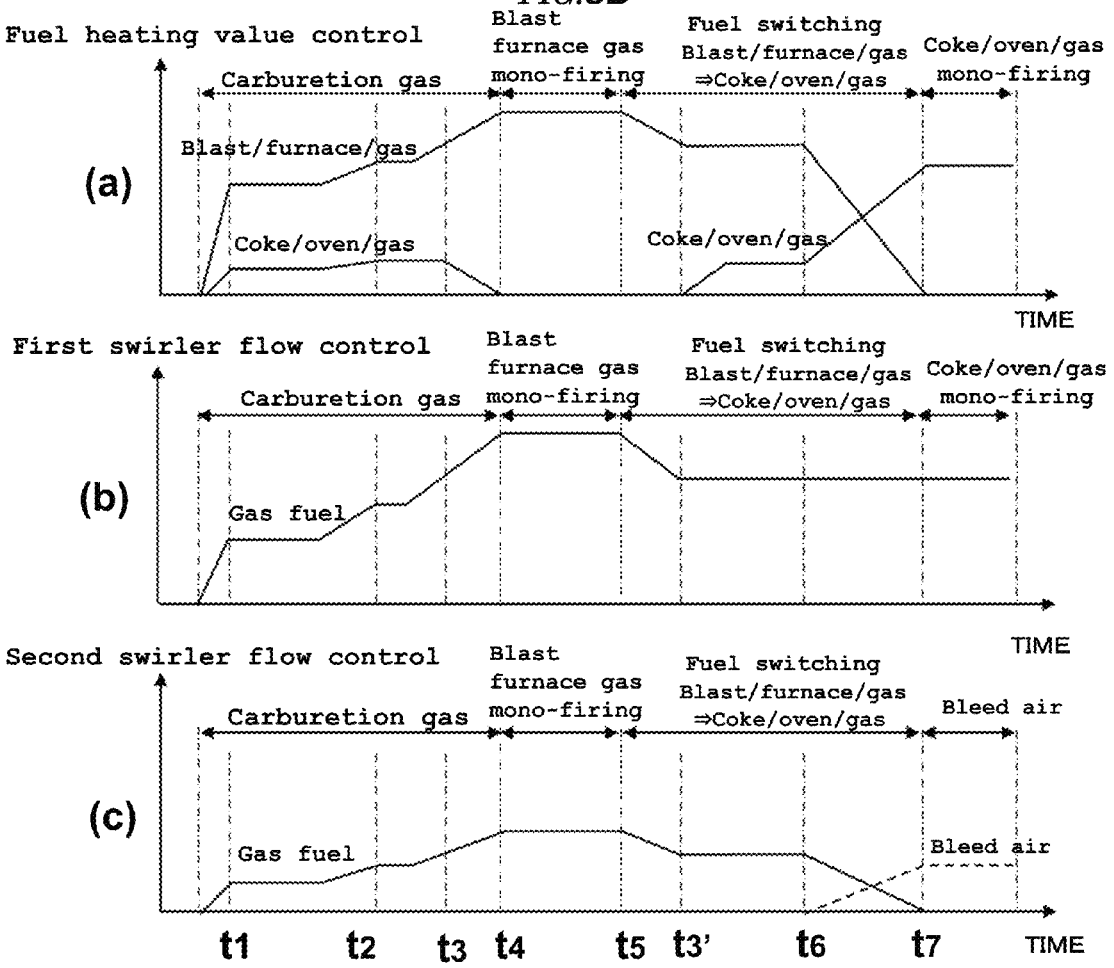
FIG. 8B is a characteristic diagram showing the flow characteristics of fluids jetted from the first swirler and the second swirler during the blast furnace gas firing in the first embodiment of the gas turbine combustor of the present invention.

A description is next given of the behavior of the fuel flow rate and the bleed air flow rate encountered during the blast furnace gas firing operation and when fuel is switched from the blast furnace gas 90 to the coke oven gas 380 with reference to FIGS. 8A and 8B. FIG. 8A is a schematic configuration diagram including a front view of the burner constituting the first embodiment of the gas turbine combustor of the present invention and also showing the fuel system encountered during the blast furnace gas firing. FIG. 8B is a characteristic diagram showing the flow characteristics of the fluids jetted from the first swirler and the second swirler during the blast furnace gas firing. In FIGS. 8A and 8B, portions denoted by the same reference numerals as those in FIGS. 1 to 7B are like portions. Therefore, their detailed explanations are omitted.

As shown in FIG. 8A, the blast furnace gas system flow control valve 601*a* arranged in the blast furnace gas system 601 for supplying the blast furnace gas 90 and the coke oven gas system flow control valve 602*a* arranged in the coke oven gas system 602 for supplying the coke oven gas 380 are controlled. In this way, it is possible to supply via the mixer 938A to the gas turbine 5 an elemental gas such as the blast furnace gas 90 or the coke oven gas 380 and carburetion gas 938 necessary for stable combustion from the start-up and increasing speed to partial load condition of the gas turbine. Incidentally, the carburetion gas 938 is produced by mixing the coke oven gas 380 with the blast furnace gas 90.

In FIG. 8B, a horizontal axis represents time and vertical axes (a), (b) and (c) represent fuel heating value control, first swirler flow control and second swirler flow control, respectively, in the order from the upside. In the figure, symbol t1 denotes ignition time of the gas turbine 5, t2 denotes full speed no load reaching time of the gas turbine, t3 denotes partial load (50%-load) reaching time, t4 denotes full load reaching time and t5 denotes load-descending start time. In addition, symbol t6 denotes time when switching from the blast furnace gas 90 to the coke oven gas 380 is started, and t7 denotes fuel-switching completion time.

Incidentally, the fuel heating value control (a) is such that the fuel heating value control section of the controller 30 exercises flow control of the blast furnace gas 90 and the coke oven gas 380 supplied to the mixer 938A. The fuel heating value control section controls the opening of the blast furnace gas system flow control valve 601*a* and of the coke oven gas system flow control valve 602*a* so as to produce fuel gas having a predetermined heating value.

The first swirler flow control (b) is such that the first swirler flow control section of the controller 30 exercises flow control of the fuel gas supplied to the first swirler 401. The first swirler flow control section controls the opening of the flow control valve 501*a* of the first fuel system 501 so as to ensure the predetermined flow rate of the gas fuel.

The second swirler flow control (c) is such that the second swirler flow control section of the controller 30 exercises flow control of fuel gas or bleed air 701*a* supplied to the second swirler 402. The second swirler flow control section controls the opening of the flow control valve 502*a* of the second fuel system 502 and the opening of the bleed air control valve 702 so as to ensure a predetermined flow rate of the gas fuel and a predetermined flow rate of the bleed air.

Before the ignition time t1, the carburetion gas 938 that is produced by mixing the predetermined coke oven gas 380 with the blast furnace gas 380 in the mixer 938A is supplied to the gas turbine 5. After ignition is detected in the combustor 3 at the time t1, the flow rate of the carburetion gas 938 is gradually increased to increase the speed of the gas turbine 5 and the full speed no load reaching time t2 is reached. The carburetion gas 938 is lower in heating value than the coke oven gas 380. The fuel flow rate becomes greator even under the same combustion temperature conditions. Therefore, the fuel can be supplied to the respective gas holes 202, 203 of the first swirler 401 and the second swirler 402. Thus, during the operation by the carburetion gas 938, it is not necessary to supply the bleed air 701*a* to the gas holes 203 of the second swirler 402 unlike the coke oven gas firing operation.

Thereafter, the flow rate of the carburetion gas 938 is gradually increased to increase the load of the gas turbine 5 and the partial load reaching time $t_3$ is reached. If the partial load condition is reached, the outlet gas temperature of the combustor 3 is increased to allow for the stable combustion of the blast furnace gas 90. Therefore, for further increasing load operation, the coke oven gas 380 mixed in the mixer 938A is gradually reduced to produce the carburetion gas 938, as shown in (a) of FIG. 8B. The flow rate of the carburetion gas 938 is increased to raise the load of the gas turbine 5 and the full load reaching time $t_4$ is reached. If the full load is reached, the supply of the coke oven gas 380 is stopped as shown in (a) to come into the state of single fuel firing operation of the blast furnace gas 90.

Incidentally, in the case of the conventional gas turbine of blast furnace gas firing, a steel plant may be shut down for the maintenance of a blast furnace installation during the operation of blast furnace gas firing. In such a case, it is necessary to shut down the gas turbine 5 in order to stop the supply of the blast furnace gas 90. In the present embodiment, the same burner 300 can burn any fuel of the blast furnace gas 90 and the coke oven gas 380. Therefore, the fuel can be switched to the coke furnace gas 380 before the supply of the blast furnace gas 90 will be stopped. This switching of the fuel is described.

First, to bring the full load operating state into the partial load state, load-descending is started from time T5 and the partial load is reached. As shown with (a) of FIG. 8B, the coke oven gas 380 mixed in the mixer 938A is gradually increased from time t3' to produce the carburetion gas 938, and the blast furnace gas mono-firing is brought to the firing condition of the carburetion gas 938, which is held until time t6.

From time t6 at which the fuel switching from the blast furnace gas 90 to the coke oven gas 380 is started, the flow rate of the coke oven gas 380 mixed in the mixer 938A is gradually further increased and also the flow rate of the blast furnace gas 90 is gradually reduced to produce the carburetion gas 938. In this way, at fuel-switching completion time t7, the fuel for the operation of the gas turbine is switched from the carburetion gas 938 to the single firing state of the coke oven gas 380.

In the combustor 3, while the first swirler 401 holds the fuel flow rate to bring the same fuel flow condition between time t6 and time t7 as from time t3 to time t6, the gas turbine fuel is switched from the carburetion gas 938 containing the blast furnace gas 90 to only the coke oven gas 380.

In the second swirler 402, as shown in (c) of FIG. 8B, the supply of the fuel gas from the second fuel system 502 is gradually reduced by controlling the flow control valve 502*a* of the second fuel system between time t6 and time t7. At the same time, the supply of the bleed air 701*a* from the bleed air system 701 is gradually increased by controlling the bleed air control valve 702 and the bleed air 701*a* is supplied to the gas holes 203. In this way, even if imbalance of pressure between the combustors occurs, the combustion gas will not flow backward via the gas holes 203 of the second swirler 402. Thus, the reliability of the combustor 3 is improved.

An operating method of the gas turbine combustor according to the embodiment of the present invention is next described with reference to FIG. 1.

At the time of start-up, the gas turbine 5 is driven by external power such as the start-up motor 8. The speed of the gas turbine 5 is held at the speed of the combustor 3 according to an ignition condition. In this way, the combustion air 102 necessary for ignition is supplied to the combustor 3 to establish the ignition conditions.

For example, the carburetion gas 938 resulting from mixing the blast furnace gas 90 with the coke oven gas 380 is here supplied to the combustor 3. Therefore, the ignition by the carburetion gas 938 becomes possible in the combustor 3. After the ignition in the combustor 3, the combustion gas 140 is supplied to the turbine 4. The turbine 4 is increased in speed along with the increased flow rate of the carburetion gas 938. The start-up motor 8 is disengaged to bring the gas turbine 5 into self-sustained operation and the gas turbine 5 reaches the full speed no load. After the gas turbine 5 has reached the full speed no load, the generator 6 is connected to a power system. Further, the flow rate of the carburetion gas 938 is increased to raise the inlet gas temperature of the turbine 4 to raise a load.

If the gas turbine 5 reaches the partial load condition (e.g. 50%-load), the outlet gas temperature of the combustion is increased. Therefore, also the reactive property of the low combustibility gas is increased to allow for the blast furnace gas mono-firing operation by adjusting the heating value from the carburetion gas 938 to the blast furnace gas 90.

The heating value from the carburetion gas 938 to the blast furnace gas 90 is adjusted by the control of the flow rate of the blast furnace gas 90 and the coke oven gas 380 supplied to the mixer 938A. The openings of the blast furnace gas system flow control valve 601*a* and of the coke oven gas system flow control valve 602*a* are controlled so as to produce the fuel gas having a predetermined heating value.

As described with FIGS. 8A and 8B, when the gas turbine 5 is started up by the carburetion gas 938 in the present embodiment, it can be operated by supplying the fuel to any of the first swirler 401 and second swirler 402 of the burner 300. On the other hand, if the gas turbine 5 is started up by the coke oven gas 380, as described with FIGS. 7A and 7B, the bleed air 701*a* is supplied to the gas holes 203 of the second swirler 402 of the burner 300 after the ignition of the gas turbine 5 or at the time of starting increasing speed. This can prevent the backflow of the combustion gas 140 to another combustor via the gas holes 203 during the increasing speed or load operation of the gas turbine 5. In addition, this can prevent an increase in the wall temperature of the combustion chamber when the coke oven gas 380 with high flame temperature is burned.

Further, the flames formed in the burner 300 come into contact with the bleed air 701; therefore, combustion reaction is promoted. The flames are shortened in length; therefore, it becomes easy to take in the recirculation zone 50 the combustion air flowing in from the side wall of the combustion chamber. Thus, flame temperature lowers, which allows for low NOx combustion.

According to the first embodiment of the gas combustor of the present invention described above, low combustibility gas which contains a high concentration of nitrogen and carbon dioxide, such as the blast furnace gas 90, and gas such as the coke oven gas 380 that have a higher heating value than the blast furnace gas 90 can be burned by the same burner 300. As a result, it is possible for gas turbine combustor to have a stable combustion using such as the coke oven gas 380 as main fuel during the maintenance of a blast furnace facilities.

Second Embodiment

Figure 9:
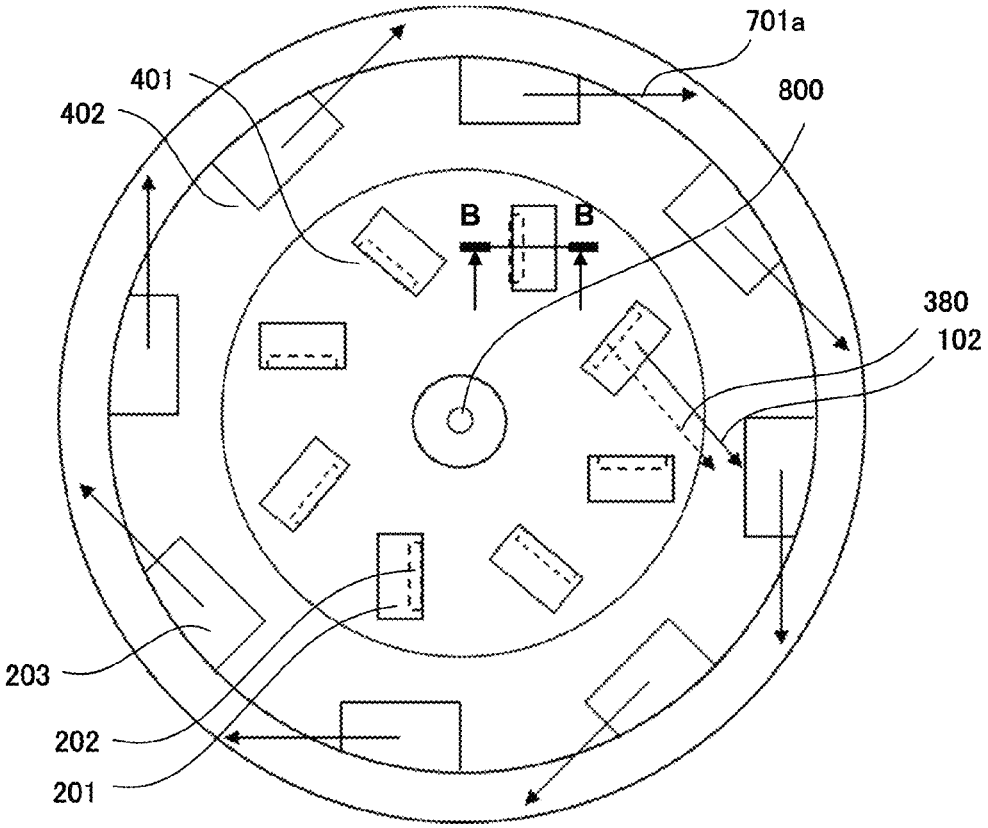
FIG. 9 is a front view illustrating a burner constituting a second embodiment of the gas turbine combustor of the present invention as viewed from the combustion chamber side.
Figure 10:
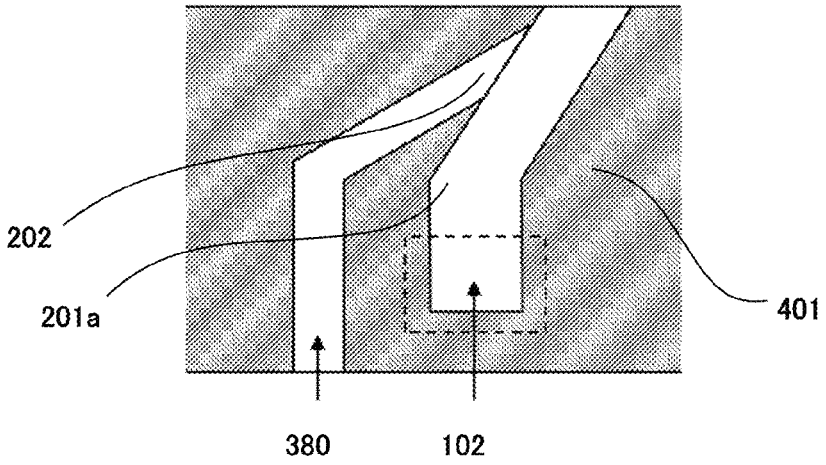
FIG. 10 is a cross-sectional view of the burner illustrated in FIG. 9 as viewed from arrows B-B.

A second embodiment of the gas turbine combustor of the present invention is hereinafter described with reference to the drawings. FIG. 9 is a front view illustrating a burner constituting the second embodiment of the gas turbine combustor of the present invention as viewed from the combustion chamber side. FIG. 10 is a cross-sectional view of the burner illustrated in FIG. 9 as viewed from arrows B-B. In FIGS. 9 and 10, portions denoted by the same reference numerals as in FIGS. 1 to 8B are like portions. Therefore, their detailed explanations are omitted.

The second embodiment of the gas turbine combustor of the present invention shown in FIGS. 9 and 10 is generally constituted by the same devices as in the first embodiment. However, the second embodiment is different from the first embodiment in the following configurations. Specifically, the present embodiment is different from the first embodiment in that a start-up nozzle for liquid fuel is provided at the radially central portion of the burner 300 and in that an outlet of a gas hole 202 of the first swirler 401 is provided in an air passage 201*a* of the first swirler 401.

To allow for stable combustion in a range from the ignition, start-up and increasing speed to partial load (e.g. a 50%-load) of the gas turbine, the start-up nozzle 800 enables smooth operation even until the blast furnace gas mono-firing by switching fuel from the start-up fuel to the blast furnace gas 90 under the partial load condition. Incidentally, the start-up fuel may be provided for even the coke oven gas firing in some cases.

It is assumed here that the burner 300 of the first embodiment illustrated in FIG. 2 is provided with the start-up nozzle 800 and the gas turbine 5 is operated by start-up fuel. The gas holes 202 of the first swirler 401 directly face the combustion chamber 12 to communicate therewith. If a difference in pressure occurs between the combustors, there is a possibility that the high-temperature combustion gas resulting from the start-up fuel flows backward from the combustor with high pressure to the combustor with low pressure via the gas holes 202 and burns out the burner 300 and the burner body 310.

To prevent this, the bleed air system 701 provided for the second swirler 402 becomes necessary to be provided also for the first swirler 401. However, the provision of the bleed air system 701 for both the first swirler 401 and the second swirler 402 leads to a problem with not only the complications of the systems and the control but also cost-up.

As illustrated in FIG. 10, the present embodiment is characterized in that the outlet of the gas hole 202 of the first swirler 401 is provided in the air passage 201*a* of the first swirler 401. Because of such arrangement, the outlet of the gas hole 202 is constantly covered by the combustion air 102 higher in pressure than the inside of the combustion chamber 12. Thus, there is no possibility that the combustion gas 140 flows backward to another combustor even during the operation of the gas turbine 5 by the start-up fuel.

The outlet of the gas hole 202 is disposed very close to the air hole 201. Therefore, there is no possibility that flames flow backward (flash back) into the air passage 201*a* of the burner 300 in the case where the coke oven gas 380 containing a high level of hydrogen is burned.

The second embodiment of the gas turbine combustor of the present invention described above can produce the same effect as that of the first embodiment.

According to the second embodiment of the gas turbine combustor of the present invention described above, the outlet of the gas hole 202 of the first swirler 401 is provided in the air passage 201*a* of the first swirler 401. Thus, it is possible to prevent the backflow of the combustion gas 140 to another combustor even during the operation by the start-up fuel.

Incidentally, the second embodiment of the gas turbine of the present invention is described taking as an example the case where the liquid fuel is used as the start-up fuel. However, also a case where a gas nozzle for start-up that jets liquefied natural gas or liquefied petroleum gas is arranged can produce the same effect. Such a case is characterized in that the gas nozzle for start-up is arranged on the radial inside of the first swirler 401 and provided with a plurality of holes.

The present invention is not limited to the first and second embodiments but includes various modifications. The above embodiments are described in detail to explain the present invention in a comprehensive way. That is to say, the present invention shall not always be limited to the embodiments that include the constitutions described above.

What is claimed is:

1. A gas turbine combustor, comprising:

combustion chamber that mixes and burns fuel and air; and a burner disposed upstream of the combustion chamber, the burner jetting fuel and air into the combustion chamber and holding flames in the chamber;

wherein the burner includes a first swirler having a first plurality of fuel holes and a second plurality of air holes formed circumferentially of the first swirler in an alternate manner and a second swirler formed with a third plurality of holes through which to jet fuel or air;

wherein the second swirler is arranged over the outer circumference of the first swirler;

wherein each of the third plurality of holes of the second swirler is greater in width than each of the second plurality of air holes of the first swirler;

wherein the gas turbine combustor uses two kinds of fuel gases with different heating values;

wherein the gas turbine combustor further comprises:

a first fuel system that supplies a blast furnace gas from a blast furnace gas system having a lower heating value of the two kinds of fuel gases to the third plurality of holes of the second swirler; and a second fuel system that supplies a coke oven gas from a coke oven gas system having a higher heating value of the two kinds of fuel gases having different heating values to the first plurality of fuel holes of the first swirler;

wherein a bleed air system supplies bleed air from a gas turbine to the third plurality of holes of the second swirler;

wherein the first fuel system, the blast furnace gas system, the second fuel system, the coke oven gas system, and the bleed air system each comprise a corresponding glow control valve;

wherein an electronic controller is configured to provide instructions to each of the corresponding flow control valve, such that when the fuel is switched from the blast furnace gas mono-firing to the coke oven gas mono-firing, supply of the blast furnace gas to the first plurality of fuel holes of the first swirler is started in a state that decreased flow rate of the blast furnace gas supplied to the first plurality of fuel holes of the first swirler and the third plurality of holes of the second swirler while the first swirler holds a fuel flow rate supplied thereto, the flow rate of the coke oven gas is gradually increased and also a flow rate of the blast furnace gas is gradually reduced to zero, and in the second swirler, the flow rate of the blast furnace gas supplied thereto is gradually reduced to zero and also supply of the bleed air to the third plurality of holes of the second swirler is started, and when the fuel switching from the blast furnace gas mono-firing to the coke oven gas mono-firing is finished, the coke oven gas is jetted from the first plurality of fuel holes of the first swirler and the bleed air from the gas turbine is jetted from the third plurality of holes of the second swirler.

2. The gas turbine combustor according to claim 1, further comprising:

a corresponding air passage, for leading compressed air into the combustion chamber, connected to the second plurality of air holes of the first swirler;

wherein the first plurality of fuel holes of the first swirler is provided in each of the corresponding air passage of the first swirler, and wherein a start-up oil nozzle or gas nozzle is disposed on the radially inward of the first swirler.

* * * * *